US005171427A

United States Patent [19]

Klimpel et al.

[11] Patent Number: 5,171,427

[45] Date of Patent: Dec. 15, 1992

[54] SULFONATED AND CARBOXYLATE COLLECTOR COMPOSITIONS USEFUL IN THE FLOTATION OF MINERALS

[75] Inventors: Richard R. Klimpel, Midland; Donald E. Leonard, Shepherd; Gordon D. McCann, Midland, all of Mich.

[73] Assignee: The Dow Chemical Company, Midland, Mich.

[21] Appl. No.: 800,186

[22] Filed: Nov. 27, 1991

Related U.S. Application Data

[63] Continuation-in-part of Ser. No. 628,264, Dec. 17, 1990, abandoned, which is a continuation-in-part of Ser. No. 484,038, Feb. 23, 1990, Pat. No. 5,015,367.

[51] Int. Cl.[5] ..... B03D 1/012; B03D 1/02

[52] U.S. Cl. ..... 209/166; 252/61; 162/5; 162/7; 162/8

[58] Field of Search ..... 209/166, 167, 901, 902; 252/61; 162/5, 6, 7, 8

[56] References Cited

U.S. PATENT DOCUMENTS

| | | | |
|---|---|---|---|
| 1,102,874 | 7/1914 | Chapman | 209/166 |
| 2,285,394 | 6/1942 | Coke | 209/166 |
| 2,373,305 | 4/1945 | Geiseke | 209/166 |
| 2,442,455 | 6/1948 | Booth | 209/166 |
| 2,698,088 | 12/1954 | Pryor | 209/166 |
| 2,861,687 | 11/1958 | Lord | 209/167 |
| 3,122,500 | 2/1964 | Gullett | 207/166 |
| 3,214,018 | 10/1965 | Neal | 209/166 |
| 3,292,787 | 12/1966 | Fuerstenau | 209/166 |
| 3,377,234 | 4/1968 | Illingsworth | 162/5 |
| 3,405,802 | 10/1968 | Preller | 209/166 |
| 4,081,363 | 3/1978 | Grayson | 209/166 |
| 4,110,207 | 8/1978 | Wang | 209/166 |
| 4,139,482 | 2/1979 | Holme | 252/61 |
| 4,158,623 | 6/1979 | Wang | 209/166 |
| 4,172,029 | 10/1979 | Hefner | 209/166 |
| 4,231,841 | 11/1980 | Calmanti | 162/8 |
| 4,308,133 | 12/1981 | Meyer | 209/166 |
| 4,309,282 | 1/1982 | Smith, Jr. | 209/166 |
| 4,376,011 | 3/1983 | Menschhorn | 162/5 |
| 4,486,301 | 12/1984 | Hsieh | 209/166 |
| 4,507,198 | 3/1985 | Unger | 209/166 |
| 4,586,982 | 5/1986 | Poppel | 162/5 |
| 4,959,123 | 9/1990 | Lehmann | 162/5 |
| 4,964,949 | 10/1990 | Hanaguchi | 162/5 |
| 5,015,367 | 5/1991 | Klimpel et al. | 209/166 |
| 5,022,983 | 6/1991 | Myers | 209/166 |
| 5,057,209 | 10/1991 | Klimpel et al. | 209/166 |

FOREIGN PATENT DOCUMENTS

| | | | |
|---|---|---|---|
| 144208 | 10/1980 | German Democratic Rep. | 209/166 |
| 149394 | 9/1983 | Japan | 162/5 |
| 155793 | 8/1985 | Japan | 162/5 |
| 326417 | 7/1970 | Sweden | 209/166 |
| 717195 | 2/1980 | U.S.S.R. | 162/5 |

OTHER PUBLICATIONS

"Mineral and Coal Flotation Circuits" by Lynch, Johnson, Manlapig and Thorn, Advisory Editor—Fuerstenau, Elsevier Scientific Publication ©1981, pp. 13-18.

"Characterization of Pyrite from Coal Sources" by Esposito, Chander and Aplan, Process Minerology VIII, 1987.

"Flotation" vol. 2—Fuerstenau, Editor; Published by AIMMPE New York—1976.

"An Electrochemical Characterization of Pyrite from Coal and Ore Sources" by Briceno et al.—Int'l Journal of Mineral Processing—1987.

Comparative Study of the Surface Properties and the Reactivities of Coal Pyrite and Mineral Pyrite by Lai et al.—Society of Mining Engineers, Mar. 1989.

*Primary Examiner*—Stanley S. Silverman
*Assistant Examiner*—Thomas M. Lithgow

[57] ABSTRACT

Dialkylated aryl sulfonic acids or salts thereof or their mixture are useful as collectors in the flotation of minerals, particularly oxide minerals. Collector compositions comprising these salts and oleic acid are particularly useful in hard water. Collector compositions comprising these salts and sulfide collectors such as xanthates are useful in flotations conducted at natural pH of the slurry.

14 Claims, No Drawings

SULFONATED AND CARBOXYLATE COLLECTOR COMPOSITIONS USEFUL IN THE FLOTATION OF MINERALS

CROSS REFERENCE TO RELATED APPLICATIONS

This application is a continuation-in-part of U.S. Ser. No. 628,264 now abandoned, filed Dec. 17, 1990, which is a continuation-in-part of co-pending application Ser. No. 484,038, filed Feb. 23, 1990, now issued as U.S. Pat. No. 5,015,367 which is related to application Ser. No. 336,143, filed Apr. 11, 1989, now abandoned, which is a continuation-in-part of application Ser. No. 310,272, filed Feb. 13, 1989, now abandoned.

BACKGROUND OF THE INVENTION

This invention is related to the use of chemical collector compositions in the recovery of minerals by froth flotation.

Flotation is a process of treating a mixture of finely divided mineral solids, e.g., a pulverulent ore, suspended in a liquid whereby a portion of the solids is separated from other finely divided mineral solids, e.g., silica, siliceous gangue, clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth.

The minerals and their associated gangue which are treated by froth flotation generally do not possess sufficient hydrophobicity or hydrophilicity to allow adequate separation. Therefore, various chemical reagents are often employed in froth flotation to create or enhance the properties necessary to allow separation. Collectors are used to enhance the hydrophobicity and thus the floatability of different mineral values. Collectors must have the ability to (1) attach to the desired mineral species to the relative exclusion of other species present: (2) maintain the attachment in the turbulence or shear associated with froth flotation: and (3) render the desired mineral species sufficiently hydrophobic to permit the required degree of separation.

A number of other chemical reagents are used in addition to collectors. Examples of types of additional reagents used include frothers, depressants, pH regulators, such as lime and soda, dispersants and various promoters and activators. Depressants are used to increase or enhance the hydrophilicity of various mineral species and thus depress their flotation. Frothers are reagents added to flotation systems to promote the creation of a semi-stable froth. Unlike both depressants and collectors, frothers need not attach or adsorb on mineral particles.

Froth flotation has been extensively practiced in the mining industry since at least the early twentieth century. A wide variety of compounds are taught to be useful as collectors, frothers and other reagents in froth flotation. For example, xanthates, simple alkylamines, alkyl sulfates, alkyl sulfonates, carboxylic acids and fatty acids are generally accepted as useful collectors.

Reagents useful as frothers include lower molecular weight alcohols such as methyl isobutyl carbinol and glycol ethers. The specific additives used in a particular flotation operation are selected according to the nature of the ore, the conditions under which the flotation will take place, the mineral sought to be recovered and the other additives which are to be used in combination therewith.

While a wide variety of chemical reagents are recognized by those skilled in the art as having utility in froth flotation, it is also recognized that the effectiveness of known reagents varies greatly depending on the particular ore or ores being subjected to flotation as well as the flotation conditions. It is further recognized that selectivity or the ability to selectively float the desired species to the exclusion of undesired species is a particular problem.

Minerals and their associated ores are generally categorized as sulfides or oxides, with the latter group comprising oxygen-containing species such as carbonates, hydroxides, sulfates and silicates. Thus, the group of minerals categorized as oxides generally include any oxygen-containing mineral. While a large proportion of the minerals existing today are contained in oxide ores, the bulk of successful froth flotation systems is directed to sulfide ores. The flotation of oxide minerals is recognized as being substantially more difficult than the flotation of sulfide minerals and the effectiveness of most flotation processes in the recovery of oxide ores is limited.

A major problem associated with the recovery of both oxide and sulfide minerals is selectivity. Some of the recognized collectors such as the carboxylic acids, alkyl sulfates and alkyl sulfonates discussed above are taught to be effective collectors for oxide mineral ores. However, while the use of these collectors can result in acceptable recoveries, it is recognized that the selectivity to the desired mineral value is typically quite poor. That is, the grade or the percentage of the desired component contained in the recovered mineral is unacceptably low.

Due to the low grade of oxide mineral recovery obtained using conventional, direct flotation, the mining industry has generally turned to more complicated methods in an attempt to obtain acceptable recovery of acceptable grade minerals. Oxide ores are often subjected to a sulfidization step prior to conventional flotation in existing commercial processes. After the oxide minerals are sulfidized, they are then subjected to flotation using known sulfide collectors. Even with the sulfidization step, recoveries and grade are less than desirable. An alternate approach to the recovery of oxide ores is liquid/liquid extraction. A third approach used in the recovery of oxide ores, particularly iron oxides and phosphates, is reverse or indirect flotation. In reverse flotation, the flotation of the ore having the desired mineral values is depressed and the gangue or other contaminant is floated. In some cases, the contaminant is a mineral which may have value. A fourth approach to mineral recovery involves chemical dissolution or leaching.

None of these existing methods of flotation directed to oxide ores are without problems. Generally, known methods result in low recovery or low grade or both. The low grade of the minerals recovered is recognized as a particular problem in oxide mineral flotation. Known recovery methods have not been economically feasible and consequently, a large proportion of oxide ores simply are not processed. Thus, the need for improved selectivity in oxide mineral flotation is generally acknowledged by those skilled in the art of froth flotation.

SUMMARY OF THE INVENTION

The present invention is a process for the recovery of minerals by froth flotation comprising subjecting an aqueous slurry comprising particulate minerals to froth flotation in the presence of a collector comprising (1) at least one alkylated aryl monosulfonic acid or salt thereof and (2) at least one $C_{1-24}$ carboxylic acid or salt thereof under conditions such that the minerals to be recovered are floated and recovered. The recovered minerals may be the mineral that is desired or may be undesired contaminants. Additionally, the froth flotation process of this invention may utilize frothers and other flotation reagents known in the art.

The flotation process of this invention results in improvements in selectivity and thus the grade of minerals recovered from oxide and/or sulfide ores while generally maintaining or increasing overall recovery levels of the mineral desired to be recovered. It is surprising that the use of sulfonic acids or salts thereof in conjunction with the carboxylic acids or salts thereof results in improvements in selectivity and/or recovery of mineral values when compared to the use of either the sulfonic or carboxylic component alone. The use of the combination is particularly effective in water containing metal salts such as the hard water typically encountered in mineral processing.

DETAILED DESCRIPTION OF ILLUSTRATIVE EMBODIMENTS

The flotation process of this invention is useful in the recovery of mineral values from a variety of ores, including oxide ores as well as sulfide ores and mixed ores. The oxide or oxygen-containing minerals which may be treated by the practice of this invention include carbonates, sulfates, hydroxides and silicates as well as oxides.

Non-limiting examples of oxide ores which may be floated using the practice of this invention preferably include iron oxides, nickel oxides, copper oxides, phosphorus oxides, aluminum oxides and titanium oxides. Other types of oxygen-containing minerals which may be floated using the practice of this invention include carbonates such as calcite, apatite or dolomite and hydroxides such as bauxite.

Non-limiting examples of specific oxide ores which may be collected by froth flotation using the process of this invention include those containing cassiterite, hematite, cuprite, vallerite, calcite, talc, kaolin, apatite, dolomite, bauxite, spinel, corundum, laterite, azurite, rutile, magnetite, columbite, ilmenite, smithsonite, anglesite, soheelite, chromite, cerussite, pyrolusite, malachite, chrysocolla, zincite, massicot, bixbyite, anatase, brookite, tungstite, uraninite, gummite, brucite, manganite, psilomelane, goethite, limonite, chrysoberyl, microlite, tantalite, topaz and samarskite. One skilled in the art will recognize that the froth flotation process of this invention will be useful for the processing of additional ores including oxide ores, wherein oxide is defined to include carbonates, hydroxides, sulfates and silicates as well as oxides.

The process of this invention is also useful in the flotation of sulfide ores. Non-limiting examples of sulfide ores which may be floated by the process of this invention include those containing chalcopyrite, chalcocite, galena, pyrite, sphalerite, molybdenite and pentlandite.

Noble metals such as gold and silver and the platinum group metals wherein platinum group metals comprise platinum, ruthenium, rhodium, palladium, osmium, and iridium, may also be recovered by the practice of this invention. For example, such metals are sometimes found associated with oxide and/or sulfide ores. Platinum, for example, may be found associated with troilite. By the practice of the present invention, such metals may be recovered in good yield.

Ores do not always exist purely as oxide ores or as sulfide ores. Ores occurring in nature may comprise both sulfur-containing and oxygen-containing minerals as well as small amounts of noble metals as discussed above. Minerals may be recovered from these mixed ores by the practice of this invention. This may be done in a two-stage flotation where one stage comprises conventional sulfide flotation to recover primarily sulfide minerals and the other stage of the flotation utilizes the process and collector composition of the present invention to recover primarily oxide minerals and any noble metals that may be present. Alternatively, both the sulfur-containing and oxygen-containing minerals may be recovered simultaneously by the practice of this invention.

A particular feature of the process of this invention is the ability to differentially float various minerals. Without wishing to be bound by theory, it is thought that the susceptibility of various minerals to flotation in the process of this invention is related to the crystal structure of the minerals. More specifically, a correlation appears to exist between the ratio of crystal edge lengths to crystal surface area on a unit area basis. Minerals having higher ratios appear to float preferentially when compared to minerals having lower ratios. Thus, minerals whose crystal structure has 24 or more faces (Group I) are generally more likely to float than minerals having 16 to 24 faces (Group II). Group III minerals comprising minerals having 12 to 16 faces are next in order of preferentially floating followed by Group IV minerals having 8 to 12 faces.

In the process of this invention, generally Group I minerals will float before Group II minerals which will float before Group III minerals which will float before Group IV minerals. By floating before or preferentially floating, it is meant that the preferred species will float at lower collector dosages. That is, a Group I mineral may be collected at a very low dosage. Upon increasing the dosage and/or the removal of most of the Group I mineral, a Group II mineral will be collected and so on.

One skilled in the art will recognize that these groupings are not absolute. Various minerals may have different possible crystal structures. Further the size of crystals existing in nature also varies which will influence the ease with which different minerals may be floated. An additional factor affecting flotation preference is the degree of liberation. Further, within a group, that is, among minerals whose crystals have similar edge length to surface area ratios, these factors and others will influence which member of the group floats first.

One skilled in the art can readily determine which group a mineral belongs to by examining standard mineralogy characterization of different minerals. These are available, for example, in *Manual of Mineralogy*, 19th Edition, Cornelius S. Hurlbut, Jr. and Cornelis Klein (John Wiley and Sons, New York 1977). Non-limiting examples of minerals in Group I include graphite, niccolite, covellite, molybdenite and beryl.

Non-limiting examples of minerals in Group II include rutile, pyrolusite, cassiterite, anatase, calomel, torbernite, autunite, marialite, meionite, apophyllite, zircon and xenotime.

Non-limiting examples of minerals in Group III include arsenic, greenockite, millerite, zincite, corundum, hematite, brucite, calcite, magnesite, siderite, rhodochrosite, smithsonite, soda niter, apatite, pyromorphite, mimetite and vanadinite.

Non-limiting examples of minerals in Group IV include sulfur, chalcocite, chalcopyrite, stibnite, bismuthinite, loellingite, marcasite, massicot, brookite, boehmite, diaspore, goethite, samarskite, atacamite, aragonite, witherite, strontianite, cerussite, phosgenite, niter, thenardite, barite, celestite, anglesite, anhydrite, epsomite, antlerite, caledonite, triphylite, lithiophilite, heterosite, purpurite, variscite, strengite, chrysoberyl, scorodite, descloizite, mottramite, brazilianite, olivenite, libethenite, adamite, phosphuranylite, childrenite, eosphorite, scheelite, powellite, wulfenite, topaz, columbite and tantalite.

As discussed above, these groupings are theorized to be useful in identifying which minerals will be preferentially floated. However, as discussed above, the collector and process of this invention are useful in the flotation of various minerals which do not fit into the above categories. These groupings are useful in predicting which minerals will float at the lowest relative collector dosage, not in determining which minerals may be collected by flotation in the process of this invention.

The selectivity demonstrated by the collectors of this invention permit the separation of small amounts of undesired minerals from the desired minerals. For example, the presence of apatite is frequently a problem in the flotation of iron as is the presence of topaz or tourmaline in the flotation of cassiterite. Thus, the collectors of the present invention are, in some cases, useful in reverse flotation where the undesired mineral is floated such as floating topaz or tourmaline away from cassiterite or apatite from iron.

In addition to the flotation of ores found in nature, the flotation process and collector composition of this invention are useful in the flotation of minerals from other sources. One such example is the waste materials from various processes such as heavy media separation, magnetic separation, metal working and petroleum processing. These waste materials often contain minerals that may be recovered using the flotation process of the present invention. Another example is the recovery of a mixture of graphite ink and other carbon based inks in the recycling of paper. Typically such recycled papers are de-inked to separate the inks from the paper fibers by a flotation process. The flotation process of the present invention is particularly effective in such de-inking flotation processes.

In one embodiment, the aryl monosulfonic acid or sulfonate of this invention comprises an aromatic core having up to about five alkyl substituents and a sulfonic acid or sulfonate moiety. For purposes of this invention, the term sulfonate will include both the sulfonic acid moiety and the sulfonate moiety. It is preferred that this embodiment of the monosulfonate have two to three alkyl substituents and more preferred that it have two. The aromatic core preferably comprises phenol, benzene, napthalene, anthracene and compounds corresponding to the formula

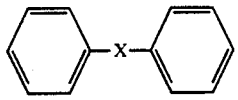

(I)

wherein X represents a covalent bond: —(CO)—; or R wherein R is a linear or branched alkyl group having one to three carbon atoms. It is preferred that the aromatic core is benzene, napthalene or biphenyl and more preferred that it is benzene or napthalene and most preferred that it is benzene.

The two or more alkyl substituents may be the same or may be different and may be ortho, para or meta to each other with para and meta being preferred and para being more preferred. The alkyl groups may be the same or different and may be substituted or unsubstituted and preferably contain from 3 to about 24 carbon atoms. More preferably each of the alkyl groups contains from about 6 to about 18 carbon atoms and most preferably about 8 to about 12 carbon atoms. The alkyl groups will contain a total of at least about 10, preferably at least about 12 and more preferably at least about 16 carbon atoms. The maximum total number of carbon atoms in the alkyl groups is preferably no greater than about 32 and more preferably no greater than about 24. The alkyl groups can be linear, cyclic or branched with linear or branched being preferred. The monosulfonates are available commercially or may be prepared by methods known in the art. For example, they may be prepared by alkylation of aryl centers using nucleophilic aromatic alkylation using alkyl halides, alcohols or alkenes as the alkylation agent with appropriate catalysts.

In this embodiment of the present invention, the aryl monosulfonate contains at least two alkyl substituents. It will be recognized by one skilled in the art that methods of production of substituted aryl monosulfonates will sometimes result in mixtures of non-substituted, mono-substituted, di-substituted and higher substituted aryl sulfonates. Such mixtures are operable in the practice of this invention. It is preferred that at least about 15 percent of the alkylated aryl sulfonates contain two or more alkyl substituents. More preferably at least about 35 percent of the alkylated aryl sulfonates contain at least two alkyl substituents and most preferably at least about 50 percent of the alkylated aryl sulfonates contain at least two alkyl substituents.

The aryl monosulfonate collector of this embodiment of the invention is preferably a dialkylated or higher alkylated benzene sulfonate collector and corresponds to the following formula or to a mixture of compounds corresponding to the formula:

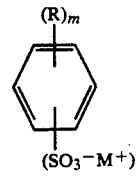

(II)

wherein each R is independently in each occurrence a saturated alkyl or substituted saturated alkyl radical or an unsaturated alkyl or substituted unsaturated alkyl radical: m is at least two and no greater than five: each M is independently hydrogen, an alkali metal, alkaline earth metal, or ammonium or substituted ammonium. Preferably, the R group(s) are independently in each occurrence an alkyl group having from about three to about 24, more preferably from about 6 to about 18 carbon atoms and most preferably about 8 to about 12 carbon atoms with the proviso that the total number of carbon atoms in the alkyl groups is at least 10, preferably at least about 12 and preferably at least 16 and no greater than about 32, preferably no greater than about 24. The alkyl groups can be linear, branched or cyclic with linear or branched radicals being preferred. The $M^+$ ammonium ion radicals are of the formula $(R')_3HN^+$ wherein each R' is independently hydrogen, a $C_1$–$C_4$ alkyl or a $C_1$–$C_4$ hydroxyalkyl radical. Illustrative $C_1$–$C_4$ alkyl and hydroxyalkyl radicals include methyl, ethyl, propyl, isopropyl, butyl, hydroxymethyl and hydroxyethyl. Typical ammonium ion radicals include ammonium ($N^+H_4$), methylammonium ($CH_3N^+H_3$), ethylammonium ($C_2H_5N^+H_3$), dimethylammonium ($(CH_3)_2N^+H_2$), methylethylammonium ($CH_3N^+H_2C_2H_5$), trimethylammonium ($(CH_3)_3N^+H$), dimethylbutylammonium ($(CH_3)_2N^+HC_4H_9$), hydroxyethylammonium ($HOCH_2CH_2N^+H_3$) and methylhydroxyethylammonium ($CH_3N^+H_2CH_2CH_2OH$). Preferably, each M is hydrogen, sodium, calcium, potassium or ammonium.

In a particular version of this preferred embodiment of the dialkylated aryl sulfonate, the alkyl groups are different. In this embodiment, it is preferred that one alkyl group is a $C_{1-3}$ alkyl group and the second alkyl group is a $C_{10-24}$ alkyl group. In the preparation of these unsymmetrical sulfonates, alphaolefins, alkyl halides and alcohols having sufficient carbon atoms to provide the desired hydrophobicity are used as alkylating agents. Typically, groups having from 10 to 24, preferably from 16 to 24 carbon atoms are used. The species which is alklyated is typically toluene, cumene, ethyl benzene, xylene. The alklyated species is sulfonated by methods known in the art.

Other sulfonates useful in the collector composition include a central aromatic group having one alkyl substituent and one non-alkyl substituent. Examples of such sulfonates include monoalkylated diphenyloxide sulfonate.

In a second preferred embodiment of this invention, the alkylated aryl monosulfonic acid or salt thereof is the alkylated diaryl oxide sulfonic acid or sulfonate described in U.S. Pat. No. 5,015,367. In a preferred embodiment, this monosulfonate is a diphenyl oxide collector and corresponds to the following formula or to a mixture of compounds corresponding to the formula:

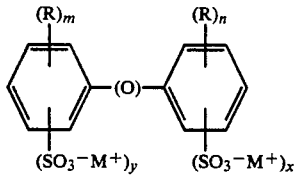

wherein each R is independently a saturated alkyl or substituted saturated alkyl radical or an unsaturated alkyl or substituted unsaturated alkyl radical; each m and n is independently 0, 1 or 2: each M is as defined above. Each x and y may independently by 0 or 1 with the proviso that the sum of x and y is one. Preferably, the R group(s) is independently an alkyl group having from about 1 to about 24, more preferably from about 6 to about 24 carbon atoms, even more preferably about 6 to about 16 carbon atoms and most preferably about 10 to about 16 carbon atoms. The alkyl groups can be linear, branched or cyclic with linear or branched radicals being preferred. It is also preferred that m and n are each one. The $M^+$ ammonium ion radicals are of the formula $(R')_3HN^+$ wherein each R' is independently hydrogen, a $C_1$–$C_4$ alkyl or a $C_1$–$C_4$ hydroxyalkyl radical. Illustrative $C_1$–$C_4$ alkyl and hydroxyalkyl radicals include methyl, ethyl, propyl, isopropyl, butyl, hydroxymethyl and hydroxyethyl. Typical ammonium ion radicals include ammonium ($N^+H_4$), methylammonium ($CH_3N^+H_3$), ethylammonium ($C_2H_5N^+H_3$), dimethylammonium ($(CH_3)_2N^+H_2$), methylethylammonium ($CH_3N^+H_2C_2H_5$), trimethylammonium ($(CH_3)_3N^+H$), dimethylbutylammonium ($(CH_3)_2N^+HC_4H_9$), hydroxyethylammonium ($HOCH_2CH_2N^+H_3$) and methylhydroxyethylammonium ($CH_3N^+H_2CH_2CH_2OH$). Preferably, each M is hydrogen, sodium, calcium, potassium or ammonium.

The second required component of the collector is a $C_{1-24}$ carboxylic acid or salt thereof. Examples of useful materials include acetic acid, citric acid, tartaric acid, maleic acid, oxalic acid, ethylenediamine dicarboxylic acid, ethyleneamine tetracarboxylic acid and fatty acids. Fatty acids or their salts are particularly preferred. Illustrative, but non-limiting examples of such acids include oleic acid, linoleic acid, linolenic acid, myristic acid, palmitic acid, strearic acid, palmitoleic acid, caprylic acid, capric acid, lauric acid and mixtures thereof. One example of a mixture of fatty acids is tall oil. Preferred fatty acids include oleic acid, linoleic acid, linolenic acid and mixtures thereof. The fatty acids may be used in the acid form or may be used in salt form. As used herein, the terms "acid" and"carboxylate" include both the acid and salt form.

The collector comprising the monosulfonate and the carboxylate is particularly useful when hard water is used in the flotation process. In the context of this invention, hard water is water having an equivalent conductivity of ionic strength equal to or greater than that of 50 ppm $Na^+$ equivalents. An effective amount of carboxylate is that amount which, when replacing an equal amount of sulfonate, results in improved recovery of the desired mineral. The amount of carboxylate used is preferably at least about 1 weight percent, more preferably at least about 2 weight percent and most preferably at least about 5 weight percent, based on the combined weight of the sulfonate and carboxylate. The maximum amount of carboxylate used is preferably no greater than about 50 weight percent, more preferably no greater than about 40 weight percent, and most preferably no greater than about 30 weight percent. As will be recognized by one skilled in the art, the optimum amount of carboxylate used will depend on the degree of hardness of the water used in flotation, the minerals to be recovered and other variables in the flotation process.

The carboxylate may be added to the flotation system prior to the addition of the sulfonate or they may be added simultaneously. It is preferred, however, that the sulfonate and carboxylate be formulated and then added to the flotation system. The collector composition may be formulated in a water based mixture or a hydrocarbon based mixture depending on the particular application. When a water formulation is used, the sulfonate and/or the carboxylate are in the salt form. When a hydrocarbon based formulation is used, one or both of the carboxylate and sulfonate are in the acid form. Typical hydrocarbon formulations would include any saturated hydrocarbon, kerosene, fuel oil, alcohols, alkylene oxide compounds, and organic solvents such dodecene, dimethylsulfoxide, limonene and dicyclopentadiene.

The type of collector formulation and whether the acid or salt form is used also impacts the preferred ratio of sulfonate to carboxylate. When the salt form is used, the amount of carboxylate used is preferably at least about 1 weight percent, more preferably at least about 2 weight percent and most preferably at least about 5 weight percent, based on the combined weight of the sulfonate and carboxylate. The maximum amount of carboxylate used is preferably no greater than about 60 weight percent, more preferably no greater than about 40 weight percent, and most preferably no greater than about 25 weight percent. When the acid form is used, the amount of carboxylate used is preferably at least about 1 weight percent, more preferably at least about 5 weight percent and most preferably at least about 10 weight percent, based on the combined weight of the sulfonate and carboxylate. The maximum amount of carboxylate used is preferably no greater than about 70 weight percent, more preferably no greater than about 50 weight percent, and most preferably no greater than about 30 weight percent.

In preferred embodiments, both the sulfonic and carboxylic components are in either the salt form or the acid form. Mixed formulations where one is a salt and the other an acid are possible, but are generally not preferred. The acid form, or hydrocarbon based formulations, are generally preferred in those situations where pH regulators are used to raise the pH above 7. In those instances where the flotation is conducted at a natural pH, it is typically preferred to use the salt form or water based formulations.

The collector composition can be used in any concentration which gives the desired selectivity and recovery of the desired mineral values. In particular, the concentration used is dependent upon the particular mineral to be recovered, the grade of the ore to be subjected to the froth flotation process and the desired quality of the mineral to be recovered.

Additional factors to be considered in determining dosage levels include the amount of surface area of the ore to be treated. As will be recognized by one skilled in the art, the smaller the particle size, the greater the surface area of the ore and the greater the amount of collector reagents needed to obtain adequate recoveries and grades. Typically, oxide mineral ores must be ground finer than sulfide ores and thus require very high collector dosages or the removal of the finest particles by desliming. Conventional processes for the flotation of oxide minerals typically require a desliming step to remove the fines present and thus permit the process to function with acceptable collector dosage levels. The collector composition of the present invention functions at acceptable dosage levels with or without desliming.

Preferably, the concentration of the collector, including the sulfonate and carboxylate, is at least about 0.001 kg/metric ton, more preferably at least about 0.05 kg/metric ton. It is also preferred that the total concentration of the collector is no greater than about 5.0 kg/metric ton and more preferred that it is no greater than about 2.5 kg/metric ton. In general, to obtain optimum performance from the collector, it is most advantageous to begin at low dosage levels and increase the dosage level until the desired effect is achieved. While the increases in recovery and grade obtained by the practice of this invention increase with increasing dosage, it will be recognized by those skilled in the art that at some point the increase in recovery and grade obtained by higher dosage is offset by the increased cost of the flotation chemicals. It will also be recognized by those skilled in the art that varying collector dosages are required depending on the type of ore and other conditions of flotation. Additionally, the collector dosage required has been found to be related to the amount of mineral to be collected. In those situations where a small amount of a mineral susceptible to flotation using the process of this invention, a very low collector dosage is needed due to the selectivity of the collector.

It has been found advantageous in the recovery of certain minerals to add the collector composition to the flotation system in stages. By staged addition, it is meant that a part of the collector dose is added: froth concentrate is collected: an additional portion of the collector is added: and froth concentrate is again collected. The total amount of collector used is preferably not changed when it is added in stages. This staged addition can be repeated several times to obtain optimum recovery and grade. The number of stages in which the collector is added is limited only by practical and economic constraints. Preferably, no more than about six stages are used.

An additional advantage of staged addition is related to the ability of the collector of the present invention to differentially float different minerals at different dosage levels. As discussed above, at low dosage levels, one mineral particularly susceptible to flotation by the collector of this invention is floated while other minerals remain in the slurry. At an increased dosage, a different mineral may be floated thus permitting the separation of different minerals contained in a given ore.

In addition to the collector of this invention, other conventional reagents or additives may be used in the flotation process. Examples of such additives include various depressants and dispersants well-known to those skilled in the art. Additionally, the use of hydroxy-containing compounds such as alkanol amines or alkylene glycols has been found to useful in improving the selectivity to the desired mineral values in systems containing silica or siliceous gangue. In addition, frothers may be and typically are used. Frothers are well known in the art and reference is made thereto for the purposes of this invention. Examples of useful frothers include polyglycol ethers and lower molecular weight frothing alcohols. Additionally, the collectors of this invention may be used with hydrocarbon as an extender. Examples of hydrocarbons useful in this context include are those hydrocarbons typically used in flotation. Non-limiting examples of such hydrocarbons include fuel oil, kerosene and motor oil.

The collector composition of this invention may also be used in conjunction with other collectors. For example, it has been found that in the flotation of sulfide mineral containing ores, the use of the collector of this invention with sulfide thiol collectors such as xanthates, dithiol phosphates and trithiol carbonates is advantageous. The use of a collector composition comprising both sulfide collectors and alkylated aryl monosulfonate collectors is particularly advantageous when it is desired to conduct the flotation at natural or non-elevated slurry pH.

The collector composition of this invention may also be used in conjunction with other conventional collectors in other ways. For example, the collector of this invention may be used in a two-stage flotation in which the first flotation using the collector of this invention recovers primarily oxide minerals while a second stage flotation using conventional collectors recovers primarily sulfide minerals or additional oxide minerals. When used in conjunction with conventional collectors, a two-stage flotation may be used wherein the first stage comprises the process of this invention and is done at the natural pH of the slurry. The second stage involves conventional collectors and is conducted at an elevated pH. It should be noted that in some circumstances, it may be desirable to reverse the stages. Such a two-stage process has the advantages of using less additives to adjust pH and also permits a more complete recovery of the desired minerals by conducting flotation under different conditions.

A particular advantage of the collector of the present invention is that additional additives are not required to adjust the pH of the flotation slurry. The flotation process utilizing the collector of the present invention operates effectively at typical natural ore pH's ranging from about 5 or lower to about 9. This is particularly important when considering the cost of reagents needed to adjust slurry pH from a natural pH of around 7.0 or lower to 9.0 or 10.0 or above which is typically necessary using conventional carboxylic xanthate collectors. As noted above, a collector composition comprising the collector of the present invention and a xanthate collector is effective at a lower pH than a xanthate collector used alone.

The ability of the collector of the present invention to function at relatively low pH means that it may also be used in those instances where it is desired to lower the slurry pH. The lower limit on the slurry pH at which the present invention is operable is that pH at which the surface charge on the mineral species is suitable for attachment by the collector.

It is possible to take advantage of the tendency of different minerals to float at different pH levels using the process of this invention. This makes it possible to do one flotation at one pH to optimize flotation of a particular species. The pH can then be adjusted for a subsequent run to optimize flotation of a different species thus facilitating separation of various minerals found together.

The following examples are provided to illustrate the invention and should not be interpreted as limiting it in any way. Unless stated otherwise, all parts and percentages are by weight.

The following examples include work involving Hallimond tube flotation and flotation done in laboratory scale flotation cells. It should be noted that Hallimond tube flotation is a simple way to screen collectors, but does not necessarily predict the success of collectors in actual flotation. Hallimond tube flotation does not involve the shear or agitation present in actual flotation and does not measure the effect of frothers. Thus, while a collector generally must be effective in a Hallimond tube flotation if it is to be effective in actual flotation, a collector effective in Hallimond tube flotation will not necessarily be effective in actual flotation. It should also be noted that experience has shown that collector dosages required to obtain satisfactory recoveries in a Hallimond tube are often substantially higher than those required in a flotation cell test. Thus, the Hallimond tube work cannot precisely predict dosages that would be required in an actual flotation cell.

EXAMPLE 1—SEPARATION OF APATITE AND SILICA

A series of 30-g samples of a −10 mesh (U.S.) mixture of 10 percent apatite ($Ca_5(Cl,F)[PO_4]_3$) and 90 percent silica ($SiO_2$) is prepared. Each sample of ore is ground with 15 g of water in a rod mill (2.5 inch diameter with 0.5 inch rods) for 240 revolutions. The water used contains 5 parts $Na^+$, 4 parts $Ca^{++}$, 2 parts $Mg^{++}$, and 1 part $Fe^{+++}$ in the appropriate amounts to produce the ionic strengths indicated in the Table I. The ionic strengths are measured in $Na^+$ equivalents using a conductivity cell. The resulting pulp is transferred to a 300 ml flotation cell.

The pH of the slurry is left at natural ore pH of 6.7. After addition of the collector (in the sodium salt form) as shown in Table I, the slurry is allowed to condition for one minute. Next, the frother, a polyglycol ether available commercially from The Dow Chemical Co. as Dowfroth® 420 brand frother, is added in an amount equivalent to 0.050 kg per ton of dry ore and the slurry is allowed to condition an additional minute.

The float cell is agitated at 1800 RPM and air is introduced at a rate of 2.7 liters per minute. The froth concentrate is collected by standard hand paddling for four minutes after the start of the introduction of air into the cell. Samples of the concentrate and the tailings are dried and analyzed as described in the previous examples. The results obtained are presented in Table I below.

TABLE I

| Run | Collector | Dosage (kg/metric ton) | Phosphorus Recovery and Grade Rec | Gr | Ionic Strength of Water (ppm Na+) |
|---|---|---|---|---|---|
| 1 | Dodecyl benzene sulfonate<br>Oleate[1] | 0.150<br>0.150 | 0.614 | 0.141 | 1000 |
| 2 | Di-dodecyl benzene sulfonate<br>Oleate[1] | 0.150<br>0.050 | 0.887 | 0.140 | 1000 |
| 3 | Di-dodecyl benzene sulfonate<br>Oleate[1] | 0.150<br>0.100 | 0.904 | 0.138 | 1000 |
| 4 | Di-dodecyl benzene sulfonate<br>Oleate[1] | 0.150<br>0.150 | 0.783 | 0.136 | 1000 |
| 5 | Di-dodecyl benzene sulfonate<br>oleate[1] | 0.150<br>0.150 | 0.865 | 0.141 | 100 |
| 6 | Di-dodecyl benzene sulfonate<br>Oleate[1] | 0.150<br>0.150 | 0.840 | 0.136 | 250 |
| 7 | Di-dodecyl benzene sulfonate | 0.150 | 0.802 | 0.135 | 500 |

TABLE I-continued

| Run | Collector | Dosage (kg/metric ton) | Phosphorus Recovery and Grade Rec | Gr | Ionic Strength of Water (ppm Na+) |
|---|---|---|---|---|---|
| | Oleate[1] | 0.150 | | | |
| 8 | Di-dodecyl benzene sulfonate | 0.150 | 0.607 | 0.137 | 1000 |
| | Oleate[2] | 0.150 | | | |
| 9 | Di-dodecyl benzene sulfonate | 0.150 | 0.575 | 0.137 | 1000 |
| | Oleate[3] | 0.150 | | | |
| 10 | Di-nonyl napthalene sulfonate | 0.150 | 0.866 | 0.142 | 1000 |
| | Oleate[1] | 0.150 | | | |
| 11 | $C_{24}$ benzene sulfonate | 0.150 | 0.629 | 0.136 | 1000 |
| | Oleate[1] | 0.150 | | | |
| 12 | Mixture of di-octyl, di-nonyl and di-decyl benzene sulfonate | 0.150 | 0.734 | 0.140 | 1000 |
| | Oleate[1] | 0.150 | | | |
| 13 | Mixture of di-octyl, di-nonyl and di-decyl napthalene sulfonate | 0.150 | 0.681 | 0.140 | 1000 |
| | Oleate[1] | 0.150 | | | |
| 14 | Dodecyl diphenyl oxide sulfonate | 0.150 | 0.607 | 0.135 | 1000 |
| | Oleate[1] | 0.050 | | | |
| 15 | Di-dodecyl diphenyl oxide sulfonate | 0.150 | 0.886 | 0.140 | 1000 |
| | Oleate[1] | 0.050 | | | |
| 16 | Di-dodecyl diphenyl oxide sulfonate | 0.150 | 0.914 | 0.144 | 1000 |
| | Oleate[1] | 0.100 | | | |
| 17 | Di-dodecyl diphenyl oxide sulfonate | 0.150 | 0.810 | 0.138 | 1000 |
| | Oleate[1] | 0.150 | | | |
| 18 | Di-dodecyl diphenyl oxide sulfonate | 0.150 | 0.934 | 0.140 | 100 |
| | Oleate[1] | 0.150 | | | |
| 19 | Di-dodecyl diphenyl oxide sulfonate | 0.150 | 0.888 | 0.139 | 250 |
| | Oleate[1] | 0.150 | | | |
| 20 | Di-dodecyl diphenyl oxide sulfonate | 0.150 | 0.846 | 0.137 | 500 |
| | Oleate[1] | 0.150 | | | |
| 21 | Di-dodecyl diphenyl sulfonate | 0.150 | 0.629 | 0.140 | 1000 |
| | Oleate[2] | 0.150 | | | |
| 22 | Didodecyl diphenyl sulfonate[3] | 0.150 | 0.583 | 0.139 | 1000 |
| | Oleate[3] | 0.150 | | | |
| 23 | Di-dodecyl benzene sulfonate | 0.150 | 0.811 | 0.140 | 1000 |
| | Tall oil fatty acid, sodium salt[1] | 0.150 | | | |
| 24 | Di-dodecyl benzene sulfonate | 0.150 | 0.762 | 0.137 | 1000 |
| | Oxalic acid, sodium salt[1] | 0.150 | | | |
| 25 | Di-dodecyl benzene sulfonate | 0.150 | 0.714 | 0.136 | 1000 |
| | Tartaric acid, sodium salt[1] | 0.150 | | | |
| 26 | Di-dodecyl benzene sulfonate | 0.150 | 0.704 | 0.139 | 1000 |
| | Dodecanate[1] | 0.150 | | | |
| 27 | Di-dodecyl benzene sulfonate | 0.150 | 0.639 | 0.135 | 1000 |
| | Citric acid, sodium salt[1] | 0.150 | | | |
| 28 | Di-dodecyl benzene sulfonate | 0.150 | 0.711 | 0.138 | 1000 |
| | Ethylene diamine dicarboxylate[1] | 0.150 | | | |
| 29 | Di-dodecyl benzene sulfonate | 0.150 | 0.754 | 0.139 | 1000 |
| | Ethylene diamine tetracarboxylate[1] | 0.150 | | | |
| 30 | Di-dodecyl benzene sulfonate | 0.150 | 0.685 | 0.136 | 1000 |
| | Hydroxy ethyl iminodiacetate[1] | 0.150 | | | |
| 31 | Di-dodecyl benzene sulfonate | 0.125 | 0.876 | 0.141 | 100 |
| | Oleate[1] | 0.025 | | | |
| 32 | Di-dodecyl benzene sulfonate | 0.125 | 0.867 | 0.140 | 250 |
| | Oleate[1] | 0.025 | | | |
| 33 | Di-dodecyl benzene sulfonate | 0.125 | 0.844 | 0.139 | 500 |
| | Oleate[1] | 0.025 | | | |
| 34 | Di-dodecyl benzene sulfonate | 0.125 | 0.830 | 0.138 | 1000 |
| | Oleate[1] | 0.025 | | | |
| 35 | Di-dodecyl benzene sulfonate | 0.150 | 0.641 | 0.134 | 1000 |
| | Oleate[4] | 0.150 | | | |
| 36 | Di-dodecyl diphenyl oxide sulfonate | 0.150 | 0.651 | 0.132 | 1000 |
| | Oleate[4] | 0.150 | | | |
| 37[5] | Dodecyl benzene sulfonate | 0.300 | 0.066 | 0.084 | 1000 |
| 38[5] | Di-dodecyl benzene sulfonate | 0.150 | 0.610 | 0.135 | 1000 |
| 39[5] | Di-dodecyl benzene sulfonate | 0.300 | 0.755 | 0.108 | 1000 |
| 40[5] | Di-nonyl napthalene sulfonate | 0.300 | 0.514 | 0.124 | 1000 |
| 41[5] | Di-dodecyl diphenyloxide sulfonate | 0.300 | 0.761 | 0.112 | 1000 |
| 42[5] | Oleate | 0.300 | 0.666 | 0.134 | 1000 |
| 43[5] | Sodium salt of tall oil fatty acid | 0.300 | 0.655 | 0.119 | 1000 |
| 44[5] | $C_{24}$ benzene sulfonate | 0.300 | 0.188 | 0.125 | 1000 |

[1]Components blended together before addition to cell.
[2]Components added to cell separately and simultaneously.
[3]Carboxylate added to cell first, conditioned for one minute followed by addition of sulfonate.
[4]Sulfonate added to cell first, conditioned for one minute followed by carboxylic addition.
[5]Not an embodiment of the invention.

The data in Table I demonstrate the effectiveness of the present invention. It is of particular interest to note that the collector composition results in efficient recovery of the desired minerals in water containing high amounts of salts. When compared with either the sulfonate or carboxylate component alone, the combination results in enhanced recoveries. The importance of preferred ratios of sulfonate to carboxylate is demonstrated in, for example, Runs 15-17 and Runs 2-4.

EXAMPLE 2—HALLIMOND TUBE FLOTATION OF RUTILE, APATITE, HEMATITE AND SILICA

About 1.1 g of either the specified mineral or silica is sized to about −60 to +120 U.S. mesh and placed in a small bottle with about 20 ml of deionized water. The mixture is shaken 30 seconds and then the water phase containing some suspended fine solids or slimes is decanted. This desliming step is repeated several times.

A 150-ml portion of deionized water is placed in a 250-ml glass beaker. Next, 2.0 ml of a 0.10 molar solution of potassium nitrate is added as a buffer electrolyte. The pH is adjusted to 6.5 with the addition of 0.10N HCl and/or 0.10N NaOH. Next, a 1.0-g portion of the deslimed mineral is added along with deionized water to bring the total volume to about 180 ml. The specified sulfonate collector and sodium oleate are preblended, added to the slurry and allowed to condition with stirring for 15 minutes. The pH is monitored and adjusted as necessary using HCl and NaOH. All collectors indicated are first converted to the $Na^+$ salt form before addition.

The slurry is transferred into a Hallimond tube designed to allow a hollow needle to be fitted at the base of the 180-ml tube. After the addition of the slurry to the Hallimond tube, a vacuum of 5 inches of mercury is applied to the opening of the tube for a period of 10 minutes. This vacuum allows air bubbles to enter the tube through the hollow needle inserted at the base of the tube. During flotation, the slurry is agitated with a magnetic stirrer set at 200 revolutions per minute (RPM).

The floated and unfloated material is filtered out of the slurry and oven dried at 100° C. Each portion is weighed and the fractional recoveries of each mineral and silica are reported in Table I below. After each test, all equipment is washed with concentrated HCl and rinsed with 0.10N NaOH and deionized water before the next run.

The recovery of each mineral and silica, respectively, reported is that fractional portion of the original mineral placed in the Hallimond tube that is recovered. Thus, a recovery of 1.00 indicates that all of the material is recovered. It should be noted that although the recovery of each mineral and silica, respectively, is reported together, the data is actually collected in four experiments done under identical conditions. It should further be noted that a low silica recovery suggests a selectivity to the the desired minerals. The values given for the various mineral recoveries generally are correct to ±0.05 and those for silica recovery are generally correct to ±0.03.

The ion concentrations are indicated for those runs where metal ions have been deliberately added to the processing water for flotation. The ratio of metal ions added is five parts $Na^+$, two parts $Mg^{++}$, and one part $Fe^{+++}$ with the total amount of these ions added being determined by measuring the ionic strength of the water in equivalent $Na^+$ concentration as measured by a conductivity cell.

TABLE II

| Run | Collector (Na + Salt) | Dosage (kg/kg) | Sodium Oleate (kg/kg) | Fractional Recovery Rutile | Apatite | Hematite | Silica | Ionic Strength Water (ppm/Na+) |
|---|---|---|---|---|---|---|---|---|
| 1 | Di-dodecyl benzene monosulfonate | 0.045 | 0.005 | 0.617 | 0.568 | 0.500 | 0.043 | 1000 |
| 2 | Di-dodecyl benzene monosulfonate | 0.040 | 0.010 | 0.880 | 0.863 | 0.781 | 0.046 | 1000 |
| 3 | Mixture of di-octyl, dinonyl, di-decyl benzene monosulfonate | 0.045 | 0.005 | 0.575 | 0.540 | 0.483 | 0.043 | 1000 |
| 4 | Mixture of di-octyl, dinonyl, di-decyl benzene monosulfonate | 0.040 | 0.010 | 0.862 | 0.837 | 0.757 | 0.046 | 1000 |
| 5 | Mixture of $C_{21}$, $C_{22}$, $C_{23}$ toluene benzene sulfonate | 0.045 | 0.005 | 0.663 | 0.619 | 0.567 | 0.044 | 1000 |
| 6 | Mixture of $C_{21}$, $C_{22}$, $C_{23}$ toluene benzene sulfonate | 0.040 | 0.010 | 0.942 | 0.897 | 0.825 | 0.048 | 1000 |
| 7 | Di-dodecyl diphenyl oxide monosulfonate | 0.045 | 0.005 | 0.777 | 0.654 | 0.607 | 0.035 | 1000 |
| 8 | Di-dodecyl diphenyl oxide monosulfonate | 0.040 | 0.010 | 0.968 | 0.921 | 0.858 | 0.042 | 1000 |
| 9[1] | Di-dodecyl benzene monosulfonate | 0.050 | 0.000 | 0.466 | 0.391 | 0.337 | 0.041 | 1000 |
| 10[1] | Mixture of di-octyl, dinonyl, di-decyl benzene monosulfonate | 0.050 | 0.000 | 0.414 | 0.404 | 0.319 | 0.039 | 1000 |
| 11[1] | Mixture of $C_{21}$, $C_{22}$, $C_{23}$ toluene benzene sulfonate | 0.050 | 0.000 | 0.515 | 0.460 | 0.398 | 0.041 | 1000 |
| 12[1] | Sodium Oleate | 0.000 | 0.050 | 0.607 | 0.533 | 0.477 | 0.037 | 1000 |

[1]Not an embodiment of the invention

The above information demonstrates the effect of ratio of sulfonate to carboxylate and also shows that the combination of sulfonate and carboxylate functions better than either alone.

EXAMPLE 3—FLOTATION OF MINERALS

The procedure of Example 2 is followed with the exception that various oxide and sulfide minerals are used in place of the ores specified in Example 2. All runs are conducted at a pH of 8.0. The collector used is 0.018 of $C_{12}$ alkylated benzene sulfonic acid and 0.006 kg of oleic acid per kg of mineral. The sulfonic and oleic components are pre-blended prior to addition to the cell. In all runs, the ratio of metal ions added is five parts $Na^+$, two parts $Mg^{++}$, and one part $Fe^{+++}$ with the total amount of these ions added being sufficient to result in measured ionic strength of the water being equivalent to $Na^+$ of 1000 ppm as measured by a conductivity cell. The results obtained are shown in Table III below.

TABLE III

| Mineral | Fractional Mineral Recovery |
|---|---|
| Silica ($SiO_2$) | 0.041 |
| Cassiterite ($SnO_2$) | 0.833 |
| Bauxite [$Al(OH)_3$] | 0.663 |
| Calcite ($CaCO_3$) | 0.707 |
| Chromite ($FeCr_2O_4$) | 0.839 |
| Dolomite [$CaMg(CO_3)_2$] | 0.666 |
| Malachite [$Cu_2CO_3(OH)_2$] | 0.715 |
| Chrysocolla [$Cu_2H_2Si_2O_5(OH)_4$] | 0.715 |
| Hematite ($Fe_2O_3$) | 0.417 |
| Corundum ($A_2O_3$) | 0.739 |
| Rutile ($TiO_2$) | 0.915 |
| Apatite [$Ca_5(Cl_1F)[PO_4]_3$] | 0.804 |
| Nickel Oxide (NiO) | 0.494 |
| Galena (PbS) | 0.862 |
| Chalcopyrite ($CuFeS_2$) | 0.860 |
| Chalcocite ($Cu_2S$) | 0.825 |
| Pyrite ($FeS_2$) | 0.595 |
| Tourmaline | 0.884 |
| Sphalerite (ZnS) | 0.797 |
| Pentlandite [Ni(FeS)]① | 0.746 |
| Barite ($BaSO_4$) | 0.725 |
| Molybdenite ($MoS_2$) | 0.900 |
| Cerussite ($PbCO_3$) | 0.839 |
| Calcite ($CaCO_3$) | 0.355 |
| Beryl ($Be_3Al_2Si_6O_{18}$) | 0.818 |
| Covellite (CuS) | 0.766 |
| Zircon ($ZrSiO_4$) | 0.784 |
| Graphite (C) | 0.922 |
| Topaz [$Al_2SiO_4(F_1OH)_2$] | 0.875 |
| Scheelite ($CaWO_4$) | 0.794 |
| Anatase ($TiO_2$) | 0.860 |
| Boehmite (γAlO.OH) | 0.611 |
| Diaspore (αAlO.OH) | 0.718 |
| Goethite ($HFeO_2$) | 0.733 |

①Sample includes some pyrrhotite.

The data in Table III demonstrates the broad range of minerals which may be floated using the collector composition and process of this invention.

EXAMPLE 4—FLOTATION OF MIXED COPPER SULFIDE ORE CONTAINING MOLYBDENUM

A series of 30-gram samples of a −10 Mesh (U.S.) ore from Arizona containing a mixture of various copper oxide minerals and copper sulfide minerals plus minor amounts of molybdenum minerals is prepared. The grade of copper in the ore is 0.013 and the grade of the molybdenum is 0.00016. Each sample of ore is ground in a laboratory swing mill for 10 seconds and the resulting fines are transferred to a 300 ml flotation cell. The water used contains 600 ppm $Ca^{++}$, 20 ppm $Fe^{+++}$, 140 ppm $SO4^=$ and 50 ppm $Mg^{++}$.

Each run is conducted at a natural ore slurry pH of 6.5. The collector composition (in the sodium salt form) is added at a total dosage of 0.150 kg/ton of dry ore and the slurry is allowed to condition for one minute. Ore concentrate is collected by standard hand paddling between zero and four minutes. Just before flotation is initiated, a frother, a polyglycol ether available commercially from The Dow Chemical Company as Dowfroth ® 250 brand frother, is added in an amount equivalent to 0.030 kg/ton of dry ore.

The float cell in all runs is agitated at 1800 RPM and air is introduced at a rate of 2.7 liters per minute. Samples of the concentrates and the tailings are then dried and analyzed as described in the previous examples. The results obtained are presented in Table IV below.

TABLE IV

| Run | Collector | Dosage (kg/metric ton) | Cu Rec | Cu Grade | Mo Rec | Mo Grade |
|---|---|---|---|---|---|---|
| 1 | di-Dodecyl benzene monosulfonate | 0.145 | 0.724 | 0.150 | 0.783 | 0.038 |
| | Sodium Oleate | 0.005 | | | | |
| 2 | di-Dodecyl benzene monosulfonate | 0.140 | 0.777 | 0.161 | 0.848 | 0.043 |
| | Sodium Oleate | 0.010 | | | | |
| 3 | di-Dodecyl benzene monosulfonate | 0.135 | 0.765 | 0.161 | 0.829 | 0.042 |
| | Sodium Oleate | 0.015 | | | | |
| 4 | di-Dodecyl benzene monosulfonate | 0.120 | 0.708 | 0.153 | 0.767 | 0.038 |
| | Sodium Oleate | 0.030 | | | | |
| 5 | di-Dodecyl benzene monosulfonate | 0.105 | 0.605 | 0.137 | 0.657 | 0.028 |
| | Sodium Oleate | 0.045 | | | | |
| 6 | di-Dodecyl diphenyloxide monosulfonate | 0.140 | 0.837 | 0.176 | 0.900 | 0.048 |
| | Sodium Oleate | 0.010 | | | | |

The data in the above table demonstrate the effectiveness of the present invention in the recovery of copper and molybdenum. In particular, it shows that, in this system, the ratio of sulfonate to oleate collector that is most effective is ranges from 30:1 to 2:1.

EXAMPLE 5—FLOTATION OF IRON OXIDE ORE

A series of 600-g samples of iron oxide ore from Michigan is prepared. The ore contains a mixture of hematite, martite, goethite and magnetite mineral species. Each 600-g sample is ground along with 400 g of water containing 300 ppm $Ca^+$, 10 ppm $Fe^{+++}$, 80 ppm $SO4^=$, 20 ppm $Cl^-$ and 40 ppm $Mg^{++}$ in a rod mill at about 60 RPM for 10 minutes. The resulting pulp is transferred to an Agitair 3000 ml flotation cell outfitted with an automated paddle removal system. The collector is added and the slurry is allowed to condition for one minute. Next, an amount of a polyglycol ether frother equivalent to 40 g per ton of dry ore is added followed by another minute of conditioning.

The float cell is agitated at 900 RPM and air is introduced at a rate of 9.0 liters per minute. Samples of the froth concentrate are collected at four minutes after the start of the air flow. Samples of the froth concentrate and the tailings are dried, weighed and pulverized for analysis. They are then dissolved in acid, and the iron content determined by the use of a D C. Plasma Spectrometer. Using the assay data, the fractional recoveries and grades are calculated using standard mass balance formulas. The results are shown in Table V below.

TABLE V

| Run | Collector | Dosage (kg/metric ton) | Fe Rec | Fe Grade |
|---|---|---|---|---|
| 1① | di-Dodecyl benzene sulfonate | 0.600 | 0.588 | 0.489 |
| 2① | Di-dodecyl benzene sulfonate | 0.300 | 0.401 | 0.500 |
| 3① | Oleate | 0.600 | 0.488 | 0.477 |
| 4① | Oleate | 0.300 | 0.337 | 0.438 |
| 5 | Di-dodecyl benzene sulfonate | 0.300 | 0.694 | 0.523 |
| | Oleate③ | 0.300 | | |
| 6① | Mixture of di-octyl and di-nonyl benzene sulfonates② | 0.300 | 0.417 | 0.513 |
| 7 | Mixture of di-octyl and di-nonyl benzene sulfonates② | 0.300 | 0.703 | 0.541 |
| | Oleic Acid③ | 0.300 | | |
| 8① | Di-dodecyl benzene sulfonic acid | 0.600 | 0.504 | 0.483 |
| 9 | Di-dodecyl benzene sulfonic acid | 0.550 | 0.663 | 0.483 |
| | Oleic acid③ | 0.050 | | |
| 10 | Di-dodecyl benzene sulfonic acid | 0.500 | 0.723 | 0.526 |
| | Oleic acid③ | 0.100 | | |
| 11 | Di-dodecyl benzene sulfonic acid | 0.450 | 0.735 | 0.528 |
| | Oleic acid③ | 0.150 | | |
| 12 | Di-dodecyl benzene sulfonic acid | 0.400 | 0.663 | 0.510 |
| | Oleic acid③ | 0.200 | | |
| 13 | Di-dodecyl benzene sulfonic acid | 0.300 | 0.582 | 0.487 |
| | Oleic acid③ | 0.300 | | |
| 14 | Di-dodecyl benzene sulfonic acid | 0.538 | 0.585 | 0.481 |
| | Tall oil fatty acid③ | 0.062 | | |
| 15 | Di-dodecyl benzene sulfonic acid | 0.475 | 0.668 | 0.544 |
| | Tall oil fatty acid③ | 0.125 | | |
| 16 | Di-dodecyl benzene sulfonic acid | 0.300 | 0.602 | 0.548 |
| | Tall oil fatty acid③ | 0.300 | | |
| 17 | Di-dodecyl benzene sulfonic acid | 0.5375 | 0.527 | 0.491 |
| | Oxalic acid③ | 0.0625 | | |
| 18 | Di-dodecyl benzene sulfonic acid | 0.475 | 0.647 | 0.529 |
| | Oxalic acid③ | 0.125 | | |
| 19 | Di-dodecyl benzene sulfonic acid | 0.300 | 0.556 | 0.488 |
| | Oxalic acid③ | 0.300 | | |
| 20 | Di-dodecyl benzene sulfonic acid | 0.538 | 0.511 | 0.476 |
| | Tartaric acid③ | 0.062 | | |
| 21 | Di-dodecyl benzene sulfonic acid | 0.475 | 0.587 | 0.532 |
| | Tartaric acid③ | 0.125 | | |
| 22 | Di-dodecyl benzene sulfonic acid | 0.300 | 0.530 | 0.519 |
| | Tartaric acid③ | 0.300 | | |
| 23 | Di-dodecyl benzene sulfonic acid | 0.538 | 0.540 | 0.484 |
| | Dodecanoic acid③ | 0.062 | | |
| 24 | Di-dodecyl benzene sulfonic acid | 0.475 | 0.627 | 0.530 |
| | Dodecanoic acid③ | 0.125 | | |
| 25 | Di-dodecyl benzene sulfonic acid | 0.300 | 0.563 | 0.544 |
| | Dodecanoic acid③ | 0.300 | | |
| 26① | Tall oil fatty acid | 0.600 | 0.437 | 0.454 |
| 27① | Tall oil fatty acid | 0.300 | 0.314 | 0.432 |
| 28① | Oxalic acid | 0.600 | <0.1 | — |
| 29① | Tartaric acid | 0.600 | <0.1 | — |
| 30① | Dodecanoic acid | 0.600 | 0.288 | 0.434 |

①Not an embodiment of the invention.
②The collector is a mixture of components listed.
③The two components are mixed together before addition to cell.

The above data show the effectiveness of the present invention. It is of particular interest to note the difference in recovery obtained when using either the sulfonate or carboxylate alone as compared to using the collector composition of this invention.

EXAMPLE 6—SEPARATION OF APATITE AND SILICA

The procedure outlined in Example 1 is used in this example. The apatite used in a different ore and the water has 600 ppm $Ca^{++}$, 20 ppm $Fe^{+++}$, 140 ppm $SO_4^{=}$, and 50 ppm $Mg^{++}$. All collectors are in the acid form. The results obtained are shown in Table VI below:

TABLE VI

| Run | Collector | Dosage (kg/metric ton) | Phosphorus Recovery and Grade Rec | Grade |
|---|---|---|---|---|
| 1[1] | Oleic Acid | 0.025 | 0.249 | 0.141 |
| 2[1] | Oleic Acid | 0.050 | 0.350 | 0.139 |
| 3[1] | Oleic Acid | 0.075 | 0.538 | 0.136 |
| 4[1] | Oleic Acid | 0.150 | 0.671 | 0.134 |
| 5 | di-Dodecyl benzene sulfonic acid | 0.150 | 0.534 | 0.139 |
| 6 | di-Dodecyl benzene sulfonic acid | 0.125 | 0.449 | 0.141 |
| 7 | di-Dodecyl benzene sulfonic acid | 0.100 | 0.308 | 0.142 |
| 8 | di-Dodecyl benzene sulfonic acid | 0.075 | 0.217 | 0.144 |
| 9[2] | Oleic Acid | 0.025 | 0.637 | 0.135 |
| | di-Dodecyl benzene sulfonic acid | 0.125 | | |
| 10[2] | Oleic Acid | 0.050 | 0.753 | 0.133 |
| | di-Dodecyl benzene sulfonic acid | 0.100 | | |
| 11[2] | Oleic Acid | 0.075 | 0.814 | 0.132 |
| | di-Dodecyl benzene sulfonic acid | 0.075 | | |
| 12[2] | Oleic Acid | 0.100 | 0.729 | 0.130 |
| | di-Dodecyl benzene sulfonic acid | 0.050 | | |
| 13[3] | Oleic Acid | 0.075 | 0.790 | 0.133 |
| | di-Dodecyl benzene sulfonic acid | 0.075 | | |
| 14[4] | Oleic Acid | 0.075 | 0.636 | 0.136 |
| | di-Dodecyl benzene sulfonic acid | 0.075 | | |
| 15[2] | Fatty Acid[5] | 0.075 | 0.833 | 0.133 |
| | di-Dodecyl benzene sulfonic acid | 0.075 | | |
| 16[3] | Fatty Acid[5] | 0.075 | 0.805 | 0.132 |
| | di-Dodecyl benzene sulfonic acid | 0.075 | | |
| 17[4] | Fatty Acid[5] | 0.075 | 0.648 | 0.135 |
| | di-Dodecyl benzene sulfonic acid | 0.075 | | |
| 18[6] | Fatty Acid[5] | 0.075 | 0.863 | 0.141 |
| | di-Dodecyl benzene sulfonic acid | 0.075 | | |
| 19[6] | Fatty Acid[5] | 0.050 | 0.885 | 0.142 |
| | di-Dodecyl benzene sulfonic acid | 0.010 | | |

[1]Not an embodiment of the invention.
[2]Two components mixed together before addition to cell.
[3]First component added to cell, conditioned for one minute followed by second component added to cell conditioned for one minute.
[4]Second component added to cell, conditioned for one minute followed by addition of first component added to cell conditioned for one minute.
[5]Mixture of oleic, linoleic and linoleic acids.
[6]Mixture added to grinding step.

The data in Table VI above shows that higher collector dosages are required in the presence of the hard water used in this example. The advantage of mixing the sulfonic and carboxylic acids together prior to being added either to the float cell (Runs 9–12 and 15) or the grinding step (18–19) is demonstrated.

What is claimed is:

1. A process for the recovery of minerals by froth flotation comprising subjecting an aqueous slurry comprising particulate minerals to froth flotation in the presence of a collector composition comprising (1) a sulfonic component comprising one or more dialkylated benzene monosulfonic acids or their salts and (2) a carboxylic component comprising at least one $C_{1-24}$ carboxylic acid or salt thereof under conditions such that the minerals to be recovered are floated and recovered.

2. The process of claim 1 wherein the sulfonic component and carboxylic component are added to the slurry simultaneously.

3. The process of claim 1 wherein the carboxylic component is added to the slurry prior to the addition of the sulfonic component.

4. The process of claim 1 wherein the recovered mineral comprises graphite and the aqueous slurry further comprises pulped paper.

5. The process of claim 1 wherein the carboxylic component is a fatty acid or salt thereof or a mixture of such acids or salts.

6. The process of claim 5 wherein the fatty acid is selected from the group consisting of oleic, linoleic, linolenic, myristic, palmitic, strearic, palmitoleic, caprylic, capric and lauric acids or salts thereof or a mixture of such acids or salts.

7. The process of claim 6 wherein the acid is selected from the group consisting of oleic, linoleic and linolenic acids or salts thereof or a mixture of such acids or salts.

8. The process of claim 1 wherein the weight ratio of the sulfonic component to the carboxylic component is between 98:2 and 30:70.

9. The process of claim 1 wherein the collector composition is blended prior to addition to the aqueous slurry.

10. The process of claim 1 wherein the minerals are recovered from an oxide ore.

11. The process of claim 10 wherein the oxide ore is selected from the group consisting of copper oxide, iron oxide, nickel oxide, phosphorus oxide, aluminum oxide and titanium oxide ores.

12. The process of claim 1 wherein the minerals are recovered from a sulfide ore.

13. The process of claim 1 wherein the minerals are recovered from an ore comprising both sulfur-containing and oxygen-containing minerals.

14. The process of claim 1 wherein the sulfonic component and carboxylic component are blended prior to addition to the slurry.

* * * * *